US007300527B2

(12) United States Patent
Yoshida et al.

(10) Patent No.: US 7,300,527 B2
(45) Date of Patent: Nov. 27, 2007

(54) METHOD FOR ACTIVATING SURFACE OF BASE MATERIAL AND APPARATUS THEREOF

(75) Inventors: Hideo Yoshida, 5-33-6, Kumegawa-machi, Higashimurayama-shi, Tokyo (JP); Nobuyoshi Sato, Osaka (JP); Takeshi Sako, Hamamatsu (JP); Masato Sone, Koganei (JP); Kentaro Abe, Higashimurayama (JP); Kiyohito Sakon, Nyu-gun (JP)

(73) Assignee: Hideo Yoshida, Tokyo (JP)

( * ) Notice: Subject to any disclaimer, the term of this patent is extended or adjusted under 35 U.S.C. 154(b) by 522 days.

(21) Appl. No.: 10/297,878

(22) PCT Filed: Nov. 6, 2002

(86) PCT No.: PCT/JP02/11549

§ 371 (c)(1),
(2), (4) Date: Apr. 2, 2003

(87) PCT Pub. No.: WO03/091481

PCT Pub. Date: Jun. 11, 2003

(65) Prior Publication Data

US 2004/0011658 A1 Jan. 22, 2004

(30) Foreign Application Priority Data

Apr. 25, 2002 (JP) ..... 2002-124922

(51) Int. Cl.
*B08B 3/02* (2006.01)

(52) U.S. Cl. ..... 134/34; 134/2; 134/3; 134/6; 134/19; 134/36; 134/40; 134/41

(58) Field of Classification Search ..... 134/2, 134/3, 6, 19, 34, 36, 40, 41
See application file for complete search history.

(56) References Cited

U.S. PATENT DOCUMENTS 3,544,366 A * 12/1970 Uhlmann ..... 134/2

(Continued)

FOREIGN PATENT DOCUMENTS

JP 63-69999 3/1988

(Continued)

OTHER PUBLICATIONS

PCT/JP02/11549 priority document.*

*Primary Examiner*—Sharidan Carrillo
(74) *Attorney, Agent, or Firm*—Jordan and Hamburg LLP

(57) ABSTRACT

A method for activating the surface of a base material and an apparatus thereof, which is suited to be utilized for pretreatment in electrochemical treatment such as, for example, electroplating or the like, in which the surface of a base material such as metal can be subjected to degreasing treatment and oxide film removing treatment simultaneously, efficiently and rationally, in which productivity can be enhanced and the equipment cost can be reduced, and in which a waste solution can be rationalized so that the solution can be reutilized and the environmental pollution can be prevented. A method for activating the surface of a base material in which the surface of a member to be treated is subjected to degreasing treatment or oxide film removing treatment. Pressurized carbon dioxide is dissolved in a predetermined quantity of water, thereby preparing an oxide film removing solution having a predetermined acidic concentration.

3 Claims, 10 Drawing Sheets

U.S. PATENT DOCUMENTS

| | | | | |
|---|---|---|---|---|
| 4,135,947 | A * | 1/1979 | Rink | 134/4 |
| 5,316,591 | A * | 5/1994 | Chao et al. | 134/34 |
| 5,409,418 | A * | 4/1995 | Krone-Schmidt et al. | 451/75 |
| 5,858,107 | A * | 1/1999 | Chao et al. | 134/1 |
| 6,090,217 | A * | 7/2000 | Kittle | 134/11 |
| 6,126,697 | A * | 10/2000 | Ebberts | 8/137 |
| 6,148,645 | A * | 11/2000 | DeYoung et al. | 68/18 R |
| 6,382,886 | B1 * | 5/2002 | Jaeger | 409/131 |
| 2002/0001929 | A1 * | 1/2002 | Biberger et al. | 438/584 |
| 2004/0005992 | A1 * | 1/2004 | Ebberts | 510/276 |
| 2004/0206632 | A1 * | 10/2004 | Yoshida et al. | 205/333 |

FOREIGN PATENT DOCUMENTS

| | | | |
|---|---|---|---|
| JP | 2-190488 | | 7/1990 |
| JP | 6-306655 | | 11/1994 |
| JP | 8-41686 | | 2/1996 |
| JP | 409011132 | A * | 1/1997 |
| JP | 11-186207 | | 7/1999 |
| JP | 11-207276 | | 8/1999 |
| JP | 2000-073191 | | 3/2000 |
| JP | 2000-308862 | | 11/2000 |
| JP | 02001174521 | A * | 6/2001 |
| JP | 2002-50596 | | 2/2002 |
| WO | WO0077135 | A2 * | 12/2000 |

* cited by examiner

METHOD FOR ACTIVATING SURFACE OF BASE MATERIAL AND APPARATUS THEREOF

TECHNICAL FIELD

The present invention relates to a method for activating the surface of a base material and an apparatus thereof, which is suited to be utilized for pretreatment in electrochemical treatment such as, for example, electroplating and the like, in which the surface of a base material such as metal can be subjected to degreasing treatment and oxide film removing treatment simultaneously, efficiently and rationally, in which productivity can be enhanced and the equipment cost can be reduced, and in which a waste solution can be rationalized so that the solution can be reutilized and the environmental pollution can be prevented.

BACKGROUND ART

In electrochemical treatment such as, for example, electroplating or the like, oil and fat portion and oxide film on the surface of metal as substance to be treated are removed by degreasing cleaning and acid pickling in its pretreatment step. In doing so, the metal surface is activated so that a good metal film can be coated on the metal surface.

The degreasing and cleaning is executed in such a manner as to dip a substance to be treated in an aqueous alkali solution, while the acid pickling is executed in such a manner as to dip a substance to be treated in an acidic aqueous solution which is prepared by diluting sulfuric acid or hydrochloric acid. Thereafter, the substance to be treated is cleaned with water. Then, an acidic or alkaline chemical is put into the waste water to neutralize it and thereafter, the neutralized water is discharged from the factory.

Accordingly, the conventional pretreatment step requires a specific bath vessel and a specific water cleaning vessel. Thus, the equipment becomes large in scale, and various kinds of chemicals and a large quantity of water are required. Thus, the treatment cost is increased. Moreover, a water cleaning step is required between the degreasing treatment step and the acid pickling step, Thus, long time is required and productivity is lowered. In addition, heavy metal such as lead, zinc and the like cannot be removed in the neutralizing treatment. Thus, a water discharge equipment is required and so, the equipment cost is increased.

Moreover, in the conventional pretreatment step, work is forced to do under such inferior circumstances that the treatment solution is scattered and toxic gas is generated. In addition, there is such a problem that the substance to be treated is risked to get hydrogen brittleness by hydrogen gas which is generated in the acid pickling step. So, it is required another means for removing the hydrogen brittleness.

In order to solve those problems, Japanese Patent Application Laid-Open No. 2000-7319 discloses a method in which a solution containing phosphine as an organic solvent is utilized, a substance to be treated is dipped in this solution or this solution is coated on the substance by a brush or spray, thereby removing oil and fat portion and oxide film without a need of dangerous and/or toxic chemicals such as strong acid, cyan, etc and without substantially collapsing a base material.

However, the above-mentioned phosphine is expensive so that the production cost is increased and in addition, the oil and fat and the oxide film can not be removed to the satisfactory extent.

Incidentally, there are disclosed cleaning methods as a method for cleaning semiconductors, precision machine parts, etc., for example, in Japanese Patent Application Laid-Open Nos. 2000-308862 and H11-207276 among others, in which a supercritical fluid and a subcritical high concentration fluid are utilized as a cleaning solvent.

The former method can cope with the removal of oil and fat stuck to machine parts, etc. but it can not cope with the removal of oxide film formed on the machine parts, etc. In that case, another step for removing the oxide film is required. Thus, productivity is decreased and the equipment cost is increased.

The latter method includes a compressor capable of generating supercritical carbon dioxide, a heater, a reaction container capable of receiving therein a substance to be treated and an oil and fat portion recovery tower for releasing the supercritical state and having an oil and fat recovery member filled therein, those components being connected to each other through a circulation pipe.

The supercritical carbon dioxide is fed into the reaction container to remove the oil and fat portion stuck to the substance to be treated. Thereafter, the supercritical carbon dioxide with the oil and fat portion dissolved therein is fed into the oil and fat portion recovery tower where the pressure is reduced to release the supercritical state so that the oil and fat portion is recovered. On the other hand, the liquid-state or gas-state carbon dioxide, from which the oil and fat portion has been recovered, is fed into the compressor to generate, once again, the supercritical carbon dioxide and the supercritical carbon dioxide thus generated is reutilized.

However, although the above-mentioned method can cope with the removal of oil and fat portion stuck to the machine parts, etc., it can not cope with the removal of oxide film formed on the machine parts, etc. In that case, another step for removing the oxide film is required. Thus, productivity is decreased and the equipment cost is increased. Moreover, the oil and fat portion recovery member of the oil and fat portion recovery tower is clogged with the passage of time and therefore, replacement is required.

Moreover, as another method, there is known a method in which carbon dioxide as a cleaning medium is pressurized and the pressurized carbon dioxide is jetted from a cleaning gun so as to be thermally expanded. Then, dry ice in the form of particle is sprayed to the surface of the member to be cleaned, so that the oil and fat portion stuck to the surface of the member is blown off.

However, here again, this method can cope with the removal of oil and fat portion but it can not cope with the removal of oxide film. Moreover, there is such a problem that after the dry ice is sublimated, it is released to the air.

It is a primary object of the present invention to provide, in order to solve the above-mentioned problems, a method for activating a surface of a base material and an apparatus thereof, which is suited to be utilized for pretreatment in electrochemical treatment such as, for example, electroplating and the like, and in which an oxide film removing solution having a desired acidity concentration can easily and inexpensively be prepared with an inexpensive material.

Another object of the present invention is to provide a method for activating a surface of a base material and an apparatus thereof, in which the surface of a base material such as metal can be subjected to degreasing treatment and oxide film removing treatment simultaneously, efficiently and rationally, in which productivity can be enhanced and the equipment cost can be reduced.

A further object of the present invention is to provide a method for activating a surface of a base material and an apparatus thereof, in which utilized treatment solution is rationally processed so that it can be reutilized and safety of its discharge is ensured.

A still further object of the present invention is to provide a method for activating a surface of a base material and an apparatus thereof, in which utilized treatment solution is rationally processed and the treatment solution is effectively recovered so that the recovered treatment solution can be reutilized and safety of its discharge is ensured.

DISCLOSURE OF INVENTION

The present invention provides a method for activating a surface of a base material in which a surface of a member to be treated is subjected to degreasing or oxide film removing treatment, the method for activating a surface of a base material being characterized in that a pressurized carbon dioxide is dissolved in a predetermined quantity of water to prepare an oxide film removing solution having a predetermined acidity concentration. Owing to the above-mentioned construction, an oxide film removing solution can easily and inexpensively be prepared with an inexpensive material. Moreover, by properly adjusting the above-mentioned pressurizing state, an oxide film removing solution having a desired acidity concentration can easily be prepared.

Also, the present invention provides a method for activating a surface of a base material, wherein the oxide film removing solution is contacted with the member to be treated, thereby removing an oxide film from the member to be treated. Owing to this arrangement, the oxide film can easily and surely be removed.

Moreover, the present invention provides a method for activating a surface of a base material, wherein the carbon dioxide is finely particulated and the fine particulate carbon dioxide is contacted with the member to be treated, thereby separating or peeling off oil and stuck to the surface of the member. Owing to this arrangement, the precision for removing oil and fat stuck to the surface of the substance to be treated is enhanced in comparison with the oil and fat treatment according to the conventional dipping method.

The present invention provides a method for activating a surface of a base material, wherein the oxide film removing treatment and the degreasing treatment are simultaneously executed. Owing to this arrangement, the treatments can effectively inexpensively and rationally be executed, the productivity can be enhanced and the equipment cost can be reduced in comparison with the conventional treatment method in which those treatments are executed separately.

Also, the present invention provides a method for activating a surface of a base material, wherein the member to be treated is received in a hermetically closed space or open space, and then subjected to oxide film removing treatment and degreasing treatment simultaneously. Owing to this arrangement, the method of the present invention can meet with various working conditions.

Moreover, the present invention provides a method for activating a surface of a base material, wherein the water and the carbon dioxide are stirred. Owing to this arrangement, the degreasing treatment and the oxide film removing treatment can efficiently be executed.

The present invention provides a method for activating a surface of a base material, wherein the water is sprayed and the carbon dioxide is supplied during the spraying operation. Owing to this arrangement, the contact surface between the water and the carbon dioxide can be enlarged and the dissolving degree of the carbon dioxide can be enhanced.

The present invention provides a method for activating a surface of a base material, wherein after the degreasing treatment or the oxide film removing treatment, the treatment solution is reduced in pressure and discharged. Owing to this arrangement, the dissolving degree of the carbon dioxide is lowered and the degree of acidity of the oxide film removing solution is lowered so that the utilized treatment solution can rationally be processed and its safety is ensured thereby realizing its discharge into the drainage. Thus, the environmental pollution can be prevented.

Also, the present invention provides a method for activating a surface of a base material, wherein the utilized treatment solution is reduced in pressure and heated so as to be decomposed into water and carbon dioxide and then, discharged or reutilized. Owing to this arrangement, safety of the discharged water is ensured and the separated water and carbon dioxide can be effectively utilized.

Moreover, the present invention provides a method for activating a surface of a base material, wherein after the degreasing treatment or the oxide film removing treatment, the utilized treatment solution is transferred into another vessel, a new member to be treated is received in the another vessel and subjected to the oxide film removing treatment and the degreasing treatment simultaneously. Owing to this arrangement, the productivity of the oxide film removing treatment and the degreasing treatment with respect to the member to be treated is enhanced, so that a mass production thereof can be obtained.

The present invention provides an apparatus for activating a surface of a base material in which a surface of a member to be treated is subjected to degreasing or oxide film removing treatment, the apparatus for activating a surface of a base material being characterized in that a pressurized carbon dioxide is supplied into a hermetically closable bath vessel containing a predetermined quantity of water, the carbon dioxide is dissolved in the water, so that an oxide film removing solution having a predetermined acidity concentration can be prepared. Owing to the above-mentioned construction, an oxide film removing solution composed of a carbonated water and having a predetermined acidity concentration is prepared, so that a safe oxide film removing solution can easily and inexpensively be prepared with an inexpensive material. Moreover, by properly adjusting the pressurizing state, an oxide removing solution having a desired acidity concentration can easily be prepared.

Also, the present invention provides an apparatus for activating a surface of a base material, wherein the member to be treated is dipped in the oxide film removing solution or the oxide film removing solution is sprayed to the member to be treated, so that the oxide film can be removed. Owing to this arrangement, the apparatus according to the present invention can meet with various working conditions.

Moreover, the present invention provides an apparatus for activating a surface of a base material, wherein the carbon dioxide is supplied into the water and finely particulated and the fine particulate carbon dioxide is contacted with the member to be treated, so that oil and stuck to the surface of the member can be separated or peeled off. Owing to this arrangement, the precision for removing oil and fat can be enhanced in comparison with the oil and fat treatment according to the conventional dipping method.

The present invention provides an apparatus for activating a surface of a base material, wherein the oxide film removing treatment and the degreasing treatment are simultaneously executed. Owing to this arrangement, the treatments can effectively inexpensively and rationally be executed, the productivity can be enhanced and the equipment cost can be reduced in comparison with the conventional treatment method in which those treatments are executed separately.

Also, the present invention provides an apparatus for activating a surface of a base material, wherein the member to be treated is received in a hermetically closed space or open space, and then subjected to oxide film removing treatment and degreasing treatment simultaneously. Owing to this arrangement, the apparatus according to the present invention can meet with various working conditions.

Moreover, the present invention provides an apparatus for activating a surface of a base material, wherein the carbon dioxide is introduced into the bath vessel from a lower part thereof, and the water is introduced into the bath vessel from an upper part thereof. Owing to this arrangement, the carbon dioxide is bubbled to accelerate dissolving of the carbon dioxide. Moreover, stirring of the water and the carbon can be enhanced.

The present invention provides an apparatus for activating a surface of a base material, wherein water is sprayed to the bath vessel and the carbon dioxide is supplied into the bath vessel during the spraying operation. Owing to this arrangement, dissolving of the carbon dioxide is accelerated. Moreover, stirring of the water and the carbon dioxide can be enhanced.

Also, the present invention provides an apparatus for activating a surface of a base material, wherein after the degreasing treatment or the oxide film removing treatment, the treatment solution is reduced in pressure so that the treatment solution can be discharged. Owing to this arrangement, the dissolving degree of the carbon dioxide is lowered and the degree of acidity of the oxide film removing solution is lowered so that the utilized treatment solution can rationally be processed and its safety is ensured thereby realizing its discharge into the drainage. Thus, the environmental pollution can be prevented.

Moreover, the present invention provides an apparatus for activating a surface of a base material, wherein the utilized treatment solution is heated so as to be decomposed into water and carbon dioxide and then, discharged or reutilized. Owing to this arrangement, safety of the discharged water is ensured and the separated water and carbon dioxide can be effectively utilized.

The present invention provides an apparatus for activating a surface of a base material, wherein after the degreasing treatment or the oxide film removing treatment, the utilized treatment solution is transferred into another vessel, a new member to be treated is received in the another vessel and subjected to the oxide film removing treatment and the degreasing treatment simultaneously. Owing to this arrangement, the productivity of the oxide film removing treatment and the degreasing treatment with respect to the member to be treated is enhanced, so that a mass production thereof can be obtained.

Also, the present invention provides an apparatus for activating a surface of a base material in which a surface of a member to be treated is contacted with degreasing cleaning fluid or oxide film removing fluid so as to be activated, the apparatus for activating a surface of a base material being characterized in that there is provided supply means for transferring the degreasing fluid and the oxide film removing fluid from their respective supply sources to the member to be treated, and end portions of the respective supply means are disposed in the vicinity of the member to be treated, so that degreasing cleaning fluid and oxide film removing fluid can be sprayed to the surface of the member to be treated, on the other hand, a recovery tube is disposed such that one end thereof is faced with the surface of the member to be treated and the other end is connected to the supply source of the oxide film removing fluid, so that the degreasing cleaning fluid or the oxide film removing fluid or both of the fluids can be flowed back to the respective supply sources through the recovery tube. Owing to the above-mentioned construction, the utilized degreasing cleaning fluid and the utilized oxide film removing fluid are flowed back directly to the source for supplying the oxide film removing fluid, thus avoiding such an unreasonableness that the utilized degreasing cleaning fluid and the utilized oxide film removing fluid are once separated and then flowed back to the supply source. Moreover, a separation vessel for separating those fluids can be eliminated. In addition, the construction and the treatment step can be simplified. Thus, an apparatus of this type can easily and inexpensively be manufactured.

Moreover, the present invention provides an apparatus for activating a surface of a base material, wherein a jetting head is disposed in the vicinity of the member to be treated, one end portions of the degreasing cleaning fluid supply means and the oxide film removing fluid supply means are disposed at one side of the jetting head, and one end portion of the degreasing cleaning fluid supply means is disposed at the outside of one end portion of the oxide film removing fluid supply means. Owing to this arrangement, the degreasing cleaning, the drying and the oxide film removing are simultaneously executed with respect to the member to be treated and a sort of air curtain composed of the degreasing cleaning fluid is formed on the outside of the oxide film removing fluid so that the oxide film removing fluid and the removed oxide film are prevented from scattering. Thus, the oxide film removing fluid can be recovered with precision and the working environment can be prevented from deteriorating.

The present invention provides an apparatus for activating a surface of a base material, wherein one end portions of the degreasing cleaning fluid supply means and the recovery tube are disposed at one side of the jetting head, and one end portion of the degreasing cleaning fluid supply means is disposed at the outside of one end portion of the recovery tube. Owing to this arrangement, the degreasing cleaning, the drying and the oxide film removing are simultaneously executed with respect to the member to be treated and a sort of air curtain composed of the degreasing cleaning fluid is formed on the outside of the oxide film removing fluid so that the oxide film removing fluid and the removed oxide film are prevented from scattering. Thus, the oxide film removing fluid can be recovered with precision and the working environment can be prevented from deteriorating.

Also, the present invention provides an apparatus for activating a surface of a base material, wherein one end portions of the degreasing cleaning fluid supply means and the oxide film removing fluid supply means are disposed at one side of the jetting head, and one end portions of the degreasing cleaning fluid and the recovery tube are disposed at the other side of the jetting head. Owing to this arrangement, movement of the degreasing cleaning fluid and the oxide film removing fluid about the jetting head and treatment thereof are accelerated, and the efficient recovery of the treatment fluids can be enhanced.

Moreover, the present invention provides an apparatus for activating a surface of a base material, wherein either one end portions of the degreasing cleaning fluid supply means, the oxide film removing fluid supply means and the recovery tube, or the member to be treated is movable. Owing to this arrangement, the surface of the member to be treated can efficiently be activated and a mass production can be obtained.

The present invention provides an apparatus for activating a surface of a base material, wherein degreasing, oxide film removing and drying can be executed almost simultaneously with respect to the member to be treated. Owing to this arrangement, the series of activating treatments can smoothly and efficiently be executed with respect to the surface of the member to be treated and specific equipment for each treatment is no more required, thereby reducing the equipment cost.

Also, the present invention provides an apparatus for activating a surface of a base material, wherein the other end of the recovery tube is connected to a separation vessel, the utilized oxide film removing fluid and the utilized degreasing cleaning fluid are received in the separation vessel so that the fluids can be separated into gas and liquid, on the other hand, one end portions of return pipes capable of conveying the fluids that have been separated into gas and liquid are connected to the separation vessel, the other end portion of the return pipe for conveying the degreasing cleaning fluid, that is in a gas phase, is connected to the degreasing cleaning fluid supply means, and the other end portion of the return pipe for conveying the oxide film removing fluid, that is in a liquid phase, is connected to the oxide film removing fluid supply source. Owing to this arrangement, the utilized oxide film removing fluid and degreasing cleaning fluid are separated into a gas fluid and a liquid fluid in a separation vessel which are then flowed back to their supply sources or supply passages. Thus, the utilized treatment fluids can efficiently be recovered and reutilized.

The above objects, features and advantages of the present invention will become more manifest from the following detailed description with reference to the accompanying drawings.

BEST MODE FOR CARRYING OUT THE INVENTION

Illustrated one embodiment of the present invention will be described hereinafter in which the present invention is applied to the degreasing and oxide film removing (hereinafter referred to as acid pickling) step which is a pretreatment of electroplating (nickel plating).

Figure 1:
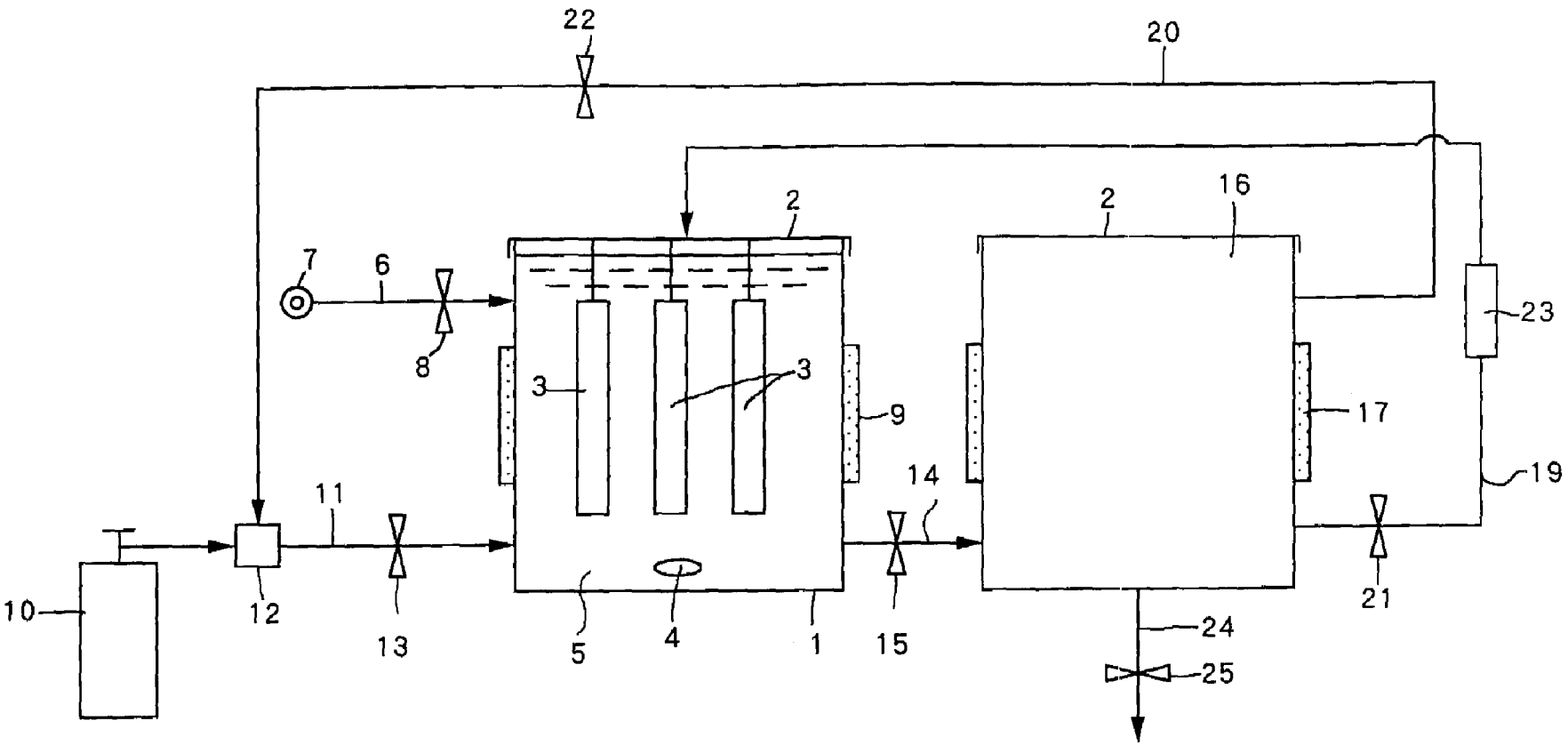
FIG. 1 is an explanatory view showing one embodiment of the present invention and showing a state in which an oxide film removal treating solution is prepared in a hermetically closed bath vessel, and a member to be treated is dipped in the treating solution and subjected to degreasing treatment and oxide film removal treatment simultaneously.
Figure 2:
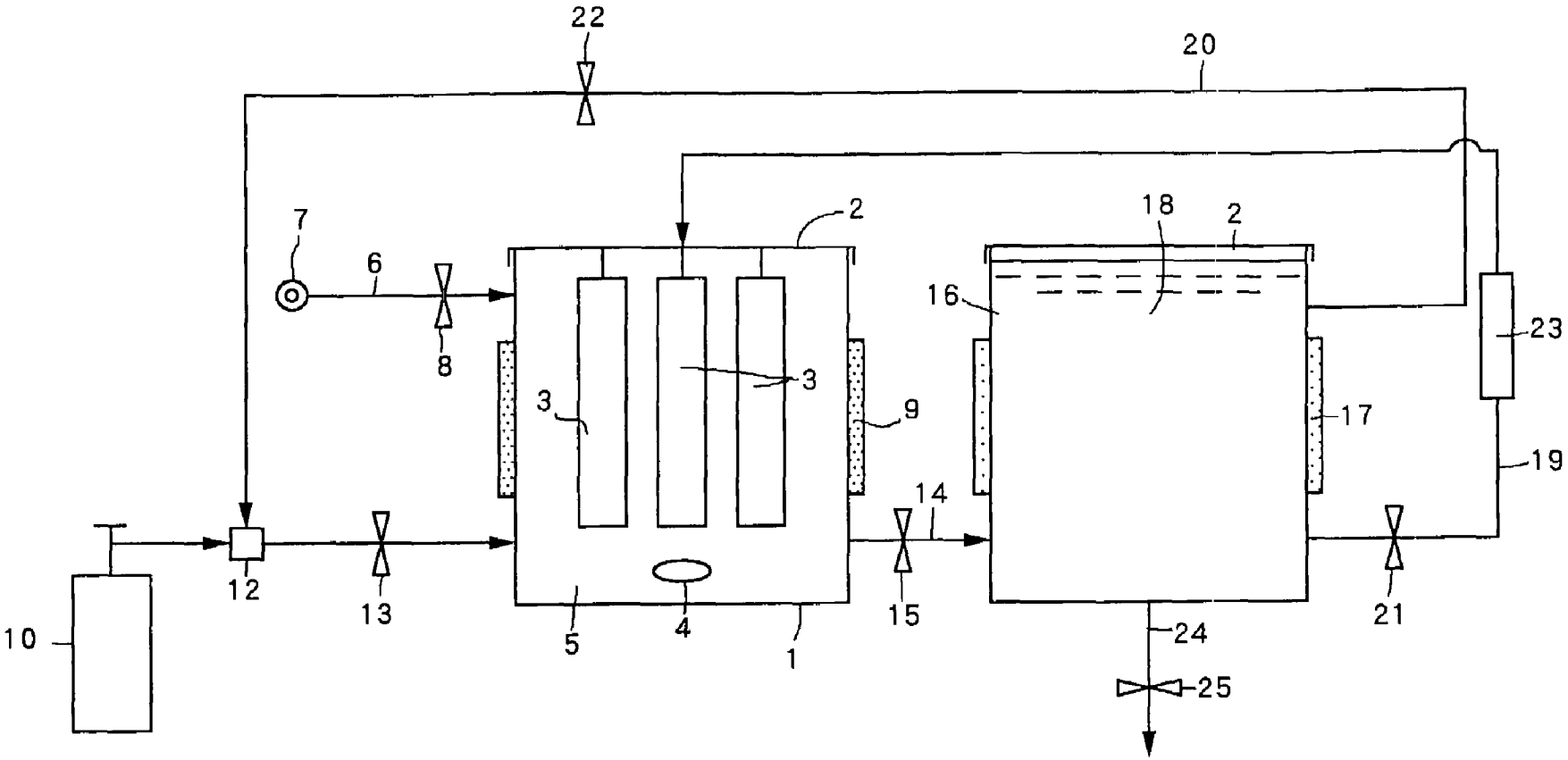
FIG. 2 shows a state in which after the degreasing treatment and oxide film removing treatment, the utilized treatment solution is shifted into another container (storage tank) for discharging, decomposing or reproducing.

In FIGS. 1 and 2, reference numeral 1 denotes a stainless steel-made bottomed cylindrical pressure-resistant vessel or acid pickling vessel (hereinafter referred to as the "bath vessel"). The inner surface of the bath vessel 1 is lined with a vinyl chloride or hard rubber. A lid member 2 is air-tightly and detachably attached to an opening portion of the bath vessel 1 which opening portion is formed in the upper side of the bath vessel 1.

A member 3 to be treated, which is an object to be degreased and which is an object from which oxide film is to be removed, is received in the bath vessel 1 such that the member 3 can be putt in and taken out of the vessel 1. A stirring element 4 such as a stirrer is received in a bottom part of the bath vessel 1.

Moreover, water 5, such as service water and pure water, is received in the bath vessel 1. A water supply tube 6 is connected to the upper peripheral surface of the bath vessel 1. This water supply tube 6 is in communication with a water supply source 7.

In the FIGURES, reference numeral 8 denotes a stop valve inserted in the water supply tube 6, and reference numeral 9 denotes a heater mounted on the peripheral surface of the bath vessel 1. This heater 9 can heat the water to a predetermined temperature, 50 o 150 degrees C. in this embodiment. The hot water heated to the above-mentioned temperature may be supplied into the bath vessel 1.

A gas container 10 containing pressurized liquid or pressurized gas, which is safe and stable, such as, for example, carbon dioxide, is placed at the outside of the bath vessel 1. A gas conduit 11 of the gas container 10 is connected to the lower peripheral surface of the bath vessel 1 through a compression pump 12 and a stop valve 13.

The compression pump 12 is adapted to pressurize the carbon dioxide to a predetermined pressure level. In this embodiment, the compression pump 12 pressurizes the carbon dioxide to a high pressure level, as higher as possible in a pressure range from the atmospheric pressure level or higher, preferably 2 atmospheric pressure level or higher to a subcritical pressure level or supercritical pressure level or higher. Then, the pressurized carbon dioxide is supplied into the bath vessel 1 and dissolved in the water 5 so as to be able to generate carbonized water ($H_2CO_2$).

In this instance, since the pressure value is related to the degree of acidity of the oxide film removing solution, the value properly adjusted to an optimal value depending on the condition of the oxide film.

A communication tube 14 is connected to a lower part of the bath vessel 1, a stop valve 15 is inserted in the tube 14, and the downstream side end portion of the communication tube 14 is connected to a storage tank 16.

The storage tank 16 is designed substantially same in construction and generally same in capacity as the bath vessel 1. A heater 17 is attached to the peripheral surface of the storage tank 16 so as to be able to heat the storage solution 18 stored in the tank 17 to a predetermined temperature.

In this embodiment, the storage solution 18 is heated to approximately 50 degrees C. so that the carbonated water, that is a chief component of the storage solution, can be decomposed into water and carbon dioxide.

One ends of return pipes 19, 20 are connected to the storage tank 16 and the other ends of the return pipes 19, 20 are connected to the bath vessel 1 and the compression pump 12, respectively, so that the decomposed water and carbon dioxide can flow back to the bath vessel 1 and the compression pump 12.

In the FIGURES, reference numeral 21, 22 denote stop valves which are inserted in the return pipes 19, 20, respectively, and reference 23 denotes a filter or ion exchange resin which is inserted in the return pipe 19.

A discharge tube 24 is connected to a lower part of the storage tank 16. The downstream side end portion of the discharge tube 24 is in communication with a drainage. Reference numeral 25 denotes a stop valve inserted in the discharge tube 24.

An apparatus for activating the surface of a base material, thus constructed, comprises the hermetically closably pressure resistant bath vessel 1, the water supply source 7 capable of supplying the water 5 to the bath vessel 1, the gas container 10 capable supplying liquid or gas, high concentration liquid carbon dioxide in this embodiment, into the bath vessel 1, and the storage tank 16 capable of primarily storing the treatment solution which has been subjected to degreasing and oxygen film removing treatment in the bath vessel 1.

Accordingly, since there is no need of a specific degreasing vessel, an acid pickling vessel, water cleaning vessels and neutralizing vessels which are all conventionally required, the equipment can be simplified, the equipment cost can be reduced and the installation space can be made compact. Since the construction is simple, the apparatus ca an be manufactured easily and inexpensively.

Moreover, the treatment solution which has been subjected to the above-mentioned various treatments is decomposed into water and carbon dioxide by the storage tank 16 as later described. Then, after removing the trashes such as oxide film deposited in the treatment solution, the resultant can be reutilized. Accordingly, the effective utilization and the reduction of consumption can be achieved.

Next, in case the degreasing treatment and the oxide film removing treatment are executed by the activating apparatus, the member 3 to be treated is received in the bath vessel 1. After the lid 2 is attached to the bath vessel 1 to hermetically close the vessel 1, the water 5 is supplied from the water source 7 into the bath vessel 1 and the member 3 is dipped in the water 5.

After a predetermined quantity of the water 5 is supplied into the bath vessel 1, carbon dioxide is supplied from the gas container 10 into the bath vessel 1 and pressurized by the compression pump 12 and then, the water 5 is heated through the heater 9. Before or after this operation, the stirring element 4 is actuated to stir the water 5.

Consequently, the carbon dioxide in the water 5 is finely particulated and moved at a high speed. A large quantity of the fine particulate carbon dioxide is collided with the member 3 to degrease the surface of the member 3 by peeling off the oil and fat stacked to the surface of the member 3.

In this case, the carbon dioxide is supplied into the bath vessel 1 through its lower part and ascended in the form of bubbling within the water 5. Thus, the carbon dioxide is rapidly dissolved in the water 5 and saturated, thereby enhancing the increase in dissolving degree. Moreover, with the help of the stirring element 4, a uniform and precision stirring effect can be obtained and the degreasing action is promoted.

Instead of the above-mentioned method, if the water is sprayed into the bath vessel 1 in a mist manner and at the same time, if the carbon dioxide is supplied thereto, the contact surface is more enlarged to enhance the increase of the dissolving degree and a precision stirring effect can be obtained. Thus, the above-mentioned degreasing action is further promoted.

Simultaneous with the stirring, the carbon dioxide is dissolved in the water 5 to generate carbon ($H_2CO_3$). Thus, the water 5 shows acidity.

In this case, since the carbon dioxide is pressurized to a high pressure level, its dissolving in the water 5 is accelerated and its dissolving amount is in proportion to the pressure.

Accordingly, the acidity of the water 5 is increased rapidly to the acidity level (PH3 to 4) which is large enough for acid pickling. Then, the water 5 having such a level of acidity as just mentioned contacts the oxide film formed on the surface of the member 3 to be treated, so that oxide film is decomposed and removed.

Moreover, since the water 5 is heated, dissolving of the carbon dioxide is accelerated to enhance the increase of the degree of acidity, and the decomposing action of the oxide film is accelerated.

In this way, the degreasing of the member 3 to be treated and the removing of the oxide film are simultaneously executed, and the oil and fat portion and the oxide film are precipitated on the bottom portion of the bath vessel 1.

After the above-mentioned pretreatment is executed and a sufficient degreasing and oxide film removing effect is obtained, the supply of the carbon dioxide is stopped to stop the driving of the stirring element 4 and the stop valve 15 is opened.

By doing so, the pressure within the bath vessel 1 is reduced to lower the dissolving degree of the carbon dioxide. Then, the treatment solution is pushed into the storage tank 16 guided by the communication tube 14. When the total quantity of the treatment solution has been shifted into the storage tank 16, the stop valve 15 is closed. This state is shown in FIG. 2.

Since the storing solution 18 in the storage tank 16 is reduced in pressure and the dissolving degree of the carbon dioxide is lowered, acidic concentration of the solution 18 is rapidly reduced and becomes to show weak acidity, which means the solution becomes practically harmless.

So, the stop valve 25 can be opened and the storing solution 18 can be discharged directly to the drainage through the discharge tube 24.

At that time, when a heavy metal is present within the storing solution 18, the heavy metal is separated from the carbonated water because the carbon dioxide disappears from the solution 18 and the separated heavy metal is precipitated within the tank 5.

Accordingly, the heavy metal can be recovered through a filter (not shown) disposed at the discharge tube 24 together with other foreign matter and the oxide film. Thus, safety of the discharged water is ensured and the environmental pollution can be prevented. The recovered heavy metal, etc. can be treated just like the normal wastes.

On the other hand, the present invention can reutilize the storing solution 18. In that event, the heater 17 is heated so that the temperature of the storing solution 18 in the storage tank 5 is raised to approximately 50 degrees C.

By doing so, the carbonated water contained in the storing solution 18 is decomposed into carbon dioxide and water. The decomposed carbon dioxide and water are separated into gas-liquid two layers. That is, the carbon dioxide in a gas state is located at an upper position and the water is located at a lower position.

Thus, when the stop valves 21, 22 are opened, the decomposed water and carbon dioxide are moved respectively into the bath vessel 1 and the compression pump 12 through the return pipes 19, 20, so that they can be reutilized.

At that time, heavy metal, oxide film and foreign matter are removed from the carbon dioxide and water through the filter 23 inserted in the return pipes 19, 20.

In that event, since the carbon dioxide is completely removed from the storing solution 18 by the above-mentioned decomposition, the heavy metal, the oxide film, etc. are completely precipitated. Thus, the precipitated heavy metal, etc. can be recovered with precision.

Since the storage tank 16 and the bath vessel 1 are constructed substantially in the same manner, it is also accepted that, for example, another member to be treated is received in the storage tank 16, the storing solution 18 is introduced into the storage tank 16, a high pressure carbon dioxide is supplied into the tank 16 from the gas container 10, the water 5 is also supplied into the tank 16 from the water supply source 7, and the inside of the tank 16 is set to the above-mentioned pressure and temperature conditions. By doing so, the degreasing treatment and the oxide film removing treatment can be executed with respect to the member 3 to be treated also in the tank 16. Thus, the productivity is enhanced.

After the above-mentioned treatment in the storage tank 16, the degree of contamination of the storing solution 18 is checked. If contamination is found as a result of checking, the pressure is lowered so that the storing solution 18 becomes to show weak acidity. Thereafter, the solution 18 is discharged into the drainage.

On the other hand, if the degree of contamination of the storing solution 18 is not heavy, the tank 16 is reduced in pressure and the storing solution 18 is decomposed into water and carbon dioxide so that they can be reutilized.

If the pressure of the carbon dioxide within the bath vessel 1 or storage tank 16 and the heating temperatures by the heaters 9, 17 are set as higher as possible, the degreasing treatment and the oxide film removing treatment can be executed with precision and in an efficient manner.

Accordingly, if the carbon dioxide is made into a supercritical state, the degreasing treatment and the oxide film removing treatment can be executed with increased precision and in a more efficient manner.

In the present invention, since the degreasing treatment and the oxide film removing treatment are simultaneously executed with respect to the member 3 to be treated using such inexpensive materials as water and carbon dioxide and no complicated water cleaning treatment is required, this type of treatment work can be made easily and rapidly. Thus, the productivity is enhanced.

Also, since toxic alkali and acidic chemicals, which have been conventionally required, are no more required as a medium for the degreasing treatment and the oxide film removing treatment, the inferior working conditions as under harmful gas generation can be improved and the treatments can be executed safely, rapidly and easily.

Moreover, the treatment solution after being utilized for the degreasing and oxide film removing treatment can be treated safely and rapidly, and the rationalization and safety of the treatment solution are ensured. The neutralizing work, which has been conventionally required, is no more required. Thus, the treatment solution can be discharged and reutilized by a simple method.

FIGS. 3 through 13 show other embodiments of the present invention, in which like parts of the above-mentioned embodiment are denoted by like reference numeral.

Figure 3:
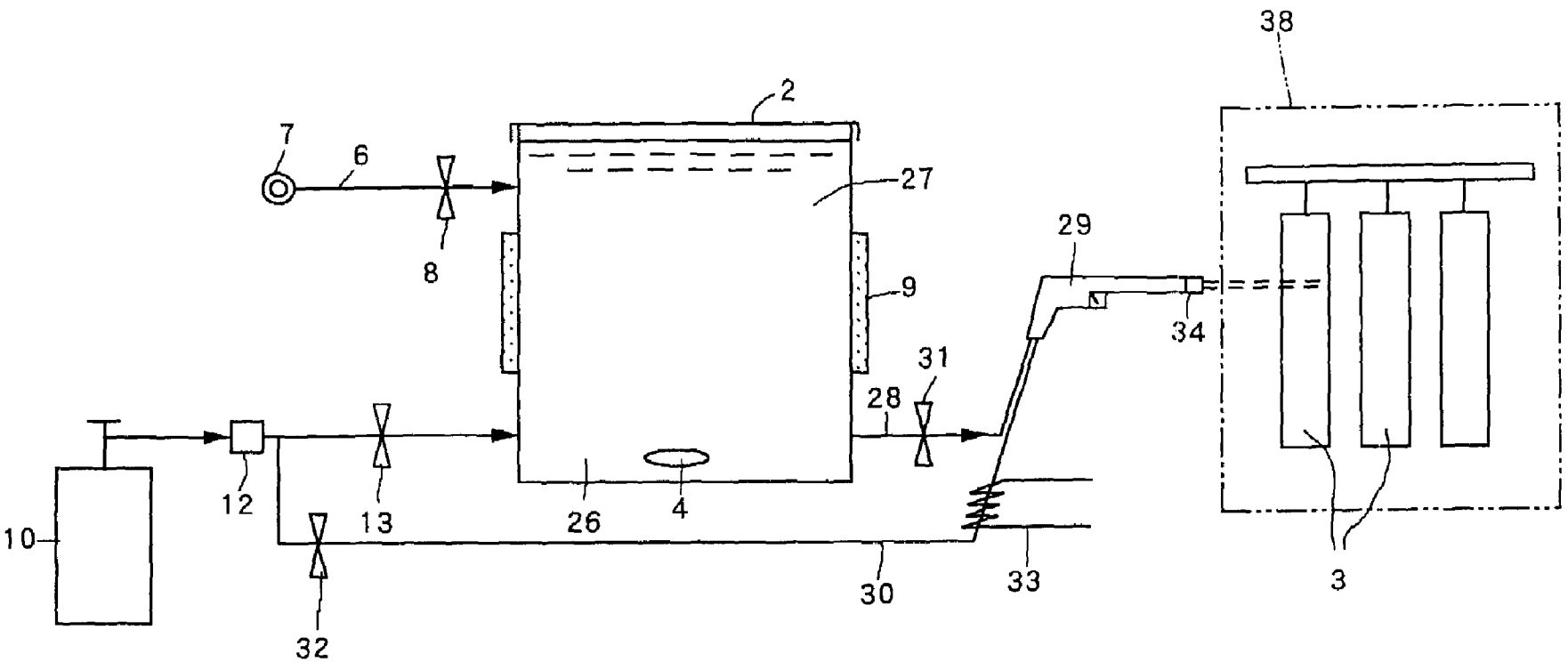
FIG. 3 shows a second embodiment of the present invention in which an oxide film removal treating solution is prepared in a hermetically closed bath vessel, the oxide film removal treating solution and a supercritical carbon are supplied to a spray gun, and a member to be treated stored in an open space is subjected to degreasing treatment and oxide film removing treatment simultaneously.
Figure 4:
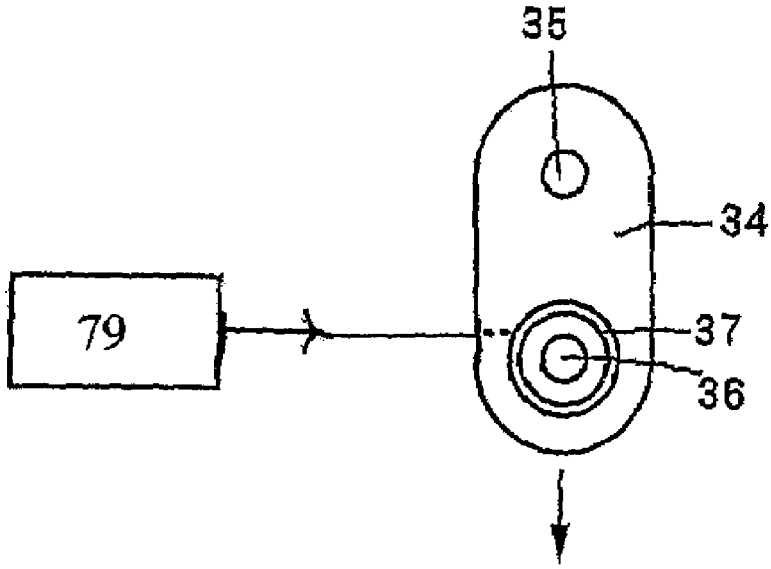
FIG. 4 is a front view showing a nozzle of the spray gun.

Among those FIGURES, FIGS. 3 and 4 show a second embodiment of the present invention. In this embodiment, a carbonated water generating vessel 26 which is similar to the above-mentioned bath vessel 1 is employed, and water and high pressure carbon dioxide are supplied into the vessel 26 to generate a predetermined quantity of carbonated water 27 having a predetermined acidity concentration in the same manner as the above-mentioned embodiment.

The carbonated water 27 is introduced into a spray gun 29 through a conduit 28 and a high pressure carbon dioxide is introduced into the spray gun 29 from the gas container 10 through a conduit 30.

In the FIGURES, reference numeral 31, 32 denote stop valves inserted into the conduits 28, 29, and reference numeral 33 denotes a heater which is located at a more downstream side (ok even within the spray gun 29) as possible of the conduit 30. The heater 33 heats the carbon dioxide within the conduit 33 into a supercritical state.

A nozzle 34 of the spray gun 29 includes, as shown in FIG. 4, jetting ports 35, 36 which are spacedly located and in communication with the conduits 28, 30, respectively, and an annular hole 37 which is located at the outside of the jetting port 36 and in communication with a compression air source 79.

Figure 5:
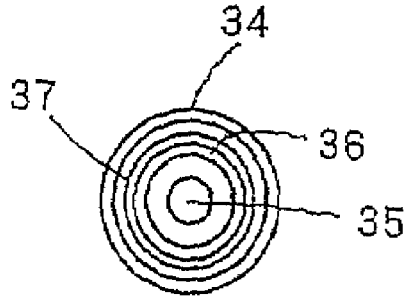
FIG. 5 is a front view showing a third embodiment of the present invention and showing another form of the nozzle of the spray gun.
Figure 6:
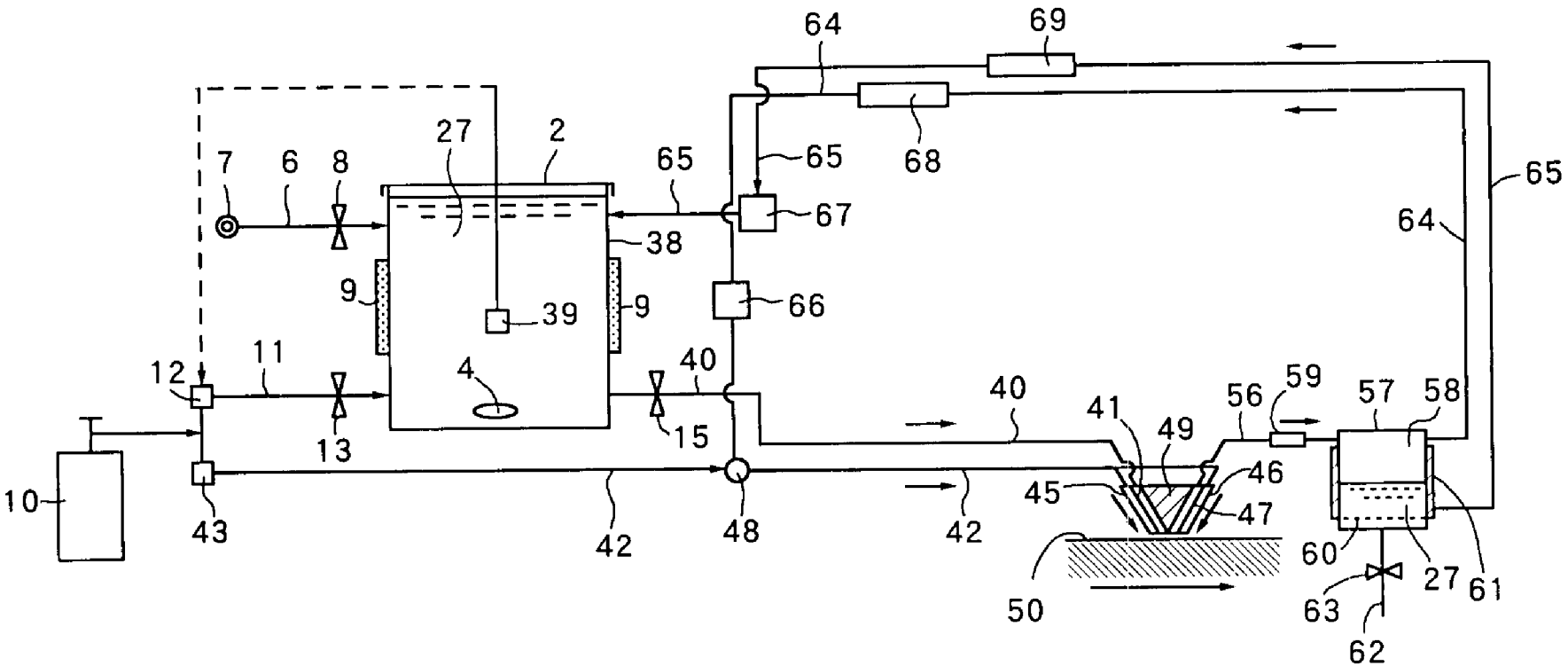
FIG. 6 is an explanatory view showing a fourth embodiment of the present invention, in which the utilized degreasing cleaning fluid and oxide film removing fluid are separated into a gas fluid and a liquid fluid in a separation vessel which are then flowed back to their supply sources or supply means.

FIG. 5 shows a third embodiment of the present invention, in which jetting ports 35, 36 are concentrically arranged and an annular hole 37, which is in communication with a compression air source (not shown) is formed at the outside of the jetting port 36 for carbon dioxide. In the FIGURE, reference numeral 38 denotes a working space for the degreasing and acid pickling treatment.

That is, in the third embodiment, instead of receiving the member 3 to be treated in the hermetically closed bath vessel 1 and executing the degreasing treatment and the oxide film removing treatment in the hermetically closed space in the manner as mentioned above, the member 3 is received in an open working space and the carbonated water 27 and the carbon dioxide in its supercritical state are sprayed to the member 3 through the spray gun 29.

By doing so, the carbon dioxide in its supercritical state is jetted from the jetting port 36, the carbonated water 27 is jetted from the jetting port 35 and the jetted carbon dioxide and carbonated water 27 are sprayed to the member 3 to be treated.

At that time, the carbon dioxide is adiabatically expanded at the time of jetting and turned into dry ice by its heat of vaporization. When the dry ice is vigorously jetted, the dry ice is atomized and collided with the member 3 to peel and blown off the oil and fat stuck to the surface of the member 3, thereby degreasing the surface of the member 3.

On the other hand, the carbonated water 27 is collided with the member 3 after the member 3 is subjected to the degreasing treatment, so that the oxide film formed on the member 3 is decomposed, removed and blown off.

The carbonated water 27 is cooled during the time it flows through the conduit 28 and the dissolving degree of the carbon dioxide is lowered, thereby lowing the acidity concentration. As a result, there is such a fear that the oxide film removing action is lowered.

Thus, the carbonated water 27 is heated to a high temperature. At the same time, the peripheral area of the nozzle 34 of the spray gun 29 is properly heated to prevent the dissolving degree of the carbon dioxide from lowering and to prevent the oxide film removing action from lowering.

After the carbonated water 27 and the supercritical carbon dioxide are sprayed to the member 3 in the manner as described above, the spraying surface is instantaneously dried because the dry ice is sublimated and the carbonated water is vigorously scattered.

The spray gun 29 is operated in the following manner. For example, the nozzle 34 is moved in the direction as indicated by an arrow of FIG. 4. Then, the supercritical carbon dioxide is sprayed to the treatment surface of the member 3 to be treated. After the treatment surface of the member 3 is subjected to degreasing treatment, the carbonated water 27 is sprayed to the surface to remove the oxide film therefrom.

In this case, the above-mentioned embodiment has such an advantage that the predetermined steps, namely, the steps for degreasing and removing the oxide film, can be obtained in a natural manner irrespective of the operating direction of the spray gun 29 because the jetting port 36 is located at the outside of the jetting port 35 and the supercritical carbon dioxide is sprayed to the treatment surface of the member 3 to be treated before the carbonated water 27 is sprayed thereto.

Moreover, an annular air stream is coaxially jetted from the annular hole 37 formed in the peripheral area of the jetting port 36 for the supercritical carbon dioxide so that disturbance of the jet stream of the dry ice is prevented and the shaping of the jet stream is enhanced. Accordingly, sureness of the treating position can be ensured when the nozzle 34 is spaced sway from the member 3 to be treated.

As previously mentioned, in this embodiment, the degreasing treatment and the oxide film removing treatment are simultaneously executed with respect to the member 3 to be treated. Moreover, since the working space 38 is in the form of an open space, the space can be obtained easily.

On the other hand, if the working space 38 is cut off from the peripheral area, that is, if the supply of oxygen is cut off in order to execute the treatment under the atmosphere of carbon dioxide, the member 3, which has been subjected to degreasing and oxide film removing treatment, can be prevented from being oxidized. If the plating treatment is executed under such an atmosphere as just mentioned, a superior metal film can be obtained.

FIGS. 6 through 9 show a fourth embodiment of the present invention. In this embodiment, reference numeral 38 denotes a bottomed cylindrical pressure-resistant corrosion-resistant liquid storage vessel as an oxide film fluid supply source, which corresponds to the above-mentioned bath vessel 1. A carbonated water 27 having a predetermined concentration, which is an oxide film removing solution (hereinafter referred to as the "acid pickling solution"), is received in the liquid storage vessel 38.

In the FIGURES, reference numeral 39 denotes a PH sensor dipped in the acid pickling solution 27 and capable of measuring the PH concentration of the acid pickling solution 27 and its detection signal is inputted in the compression pump 12 and the discharging pressure and the discharging quantity of the carbon dioxide are controlled with respect to the liquid storage vessel 38, so that the PH concentration of the acid pickling solution 27 can be adjusted.

An acid pickling solution supply tube 40 is connected to a lower part of the liquid storage vessel 38 and its downstream side end portion is connected to a jetting guide 41.

The gas conduit, which is in communication with the gas container 10, is connected to a branch portion between the flow path leading to th compression pump 12 and a degreasing cleaning fluid supply tube 42, and a pressure pump 43 is placed at an upstream side of the supply tube 42.

Figure 7:
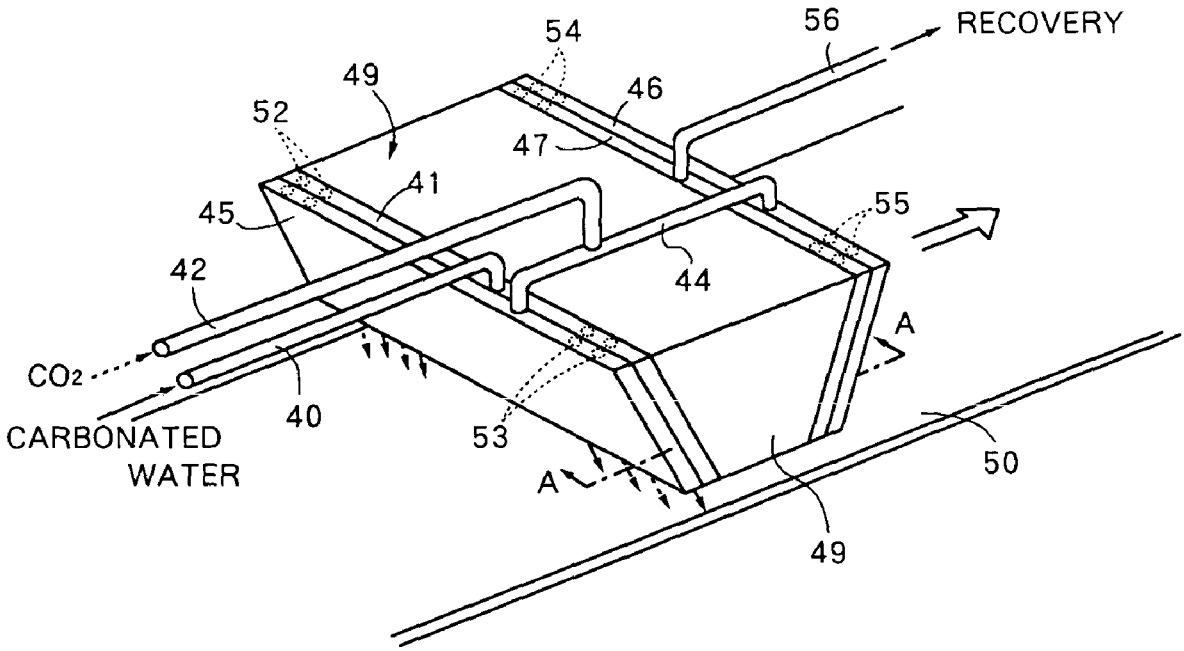
FIG. 7 is a perspective view showing a jetting head applied to the fourth embodiment, the supply means of the respective fluids arranged at the peripheral area of the head, and a piping state of a recovery tube.

As shown in FIG. 7, a branch tube 44 is connected to a downstream side end portion of the degreasing cleaning fluid supply tube 42, and a pair of jetting guides 45, 46 are connected to opposite end portions of the tube 44.

In the FIGURE, reference numeral 47 denotes a recovery guide disposed at the inside of the jetting guide 46, and reference numeral 48 denotes a check valve inserted in the degreasing cleaning fluid supply tube 42. The check valve 48 is adapted to prevent the backflow of the degreasing cleaning fluid supply tube 42.

The jetting guides 41, 45, 46 and the recovery guide 47 are all formed in a generally same plate like configuration as shown in FIG. 7. They are all disposed proximate to the opposite ends of the jetting head 49.

That is, the jetting guides 41, 45 are disposed in adjacent relation at on side of the jetting head 49, and the jetting guide 45 and the recovery guide 47 are disposed in adjacent relation at the other side. The jetting guides 45, 46 capable of jetting the carbon dioxide are disposed at the outside of the jetting head 49.

The jetting head 49 is disposed immediately above a member 50 to be treated, which is a metal plate or the like, and which is an objected to be subjected to degreasing cleaning treatment, acid pickling treatment and drying treatment, in such a manner as to be orthogonal to the moving direction of the member 50. As shown in FIG. 7, the jetting head 49 is formed in a generally trapezoidal and its length is dimensioned to be generally same as the width of the member 50 to be treated.

Also, the jetting guides 41, 45, 46 and the recovery guide 47 are disposed along the slantwise opposite side surfaces of the jetting head 49, thereby providing directivity of their jetting positions and recovery position.

Figure 9:
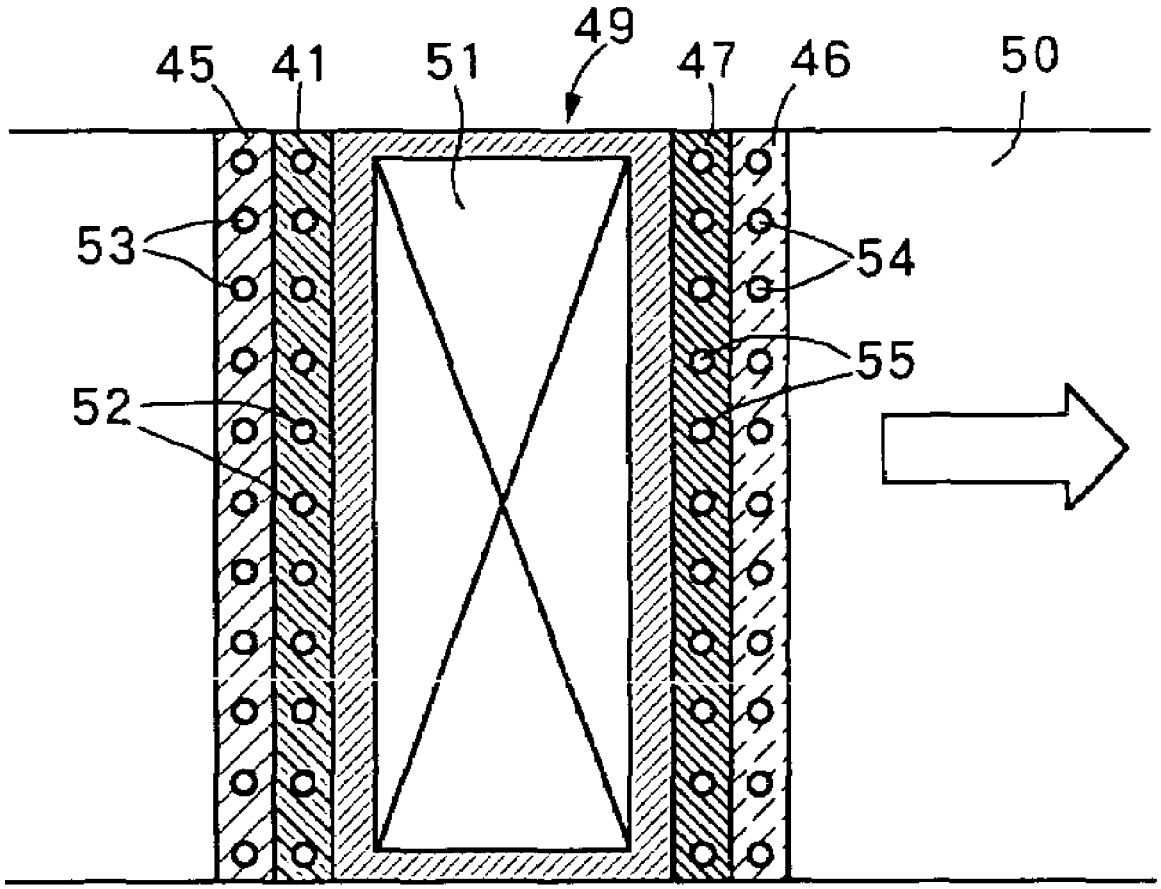
FIG. 9 is an enlarged sectional view taken on line A-A of FIG. 7.

The section of the jetting head 49 is as shown in FIG. 9. A heater 51 is disposed at the inside of the jetting head 49. Through heating action of the heater 51, the jet fluid is activated and the jet fluid is prevented from being frozen by its adiabatical expansion.

At the insides of the jetting guides 41, 45, 46 and of the recovery guide 47, a plurality of passages 52 through 55 are formed in a direction orthogonal to their width direction.

Figure 8:
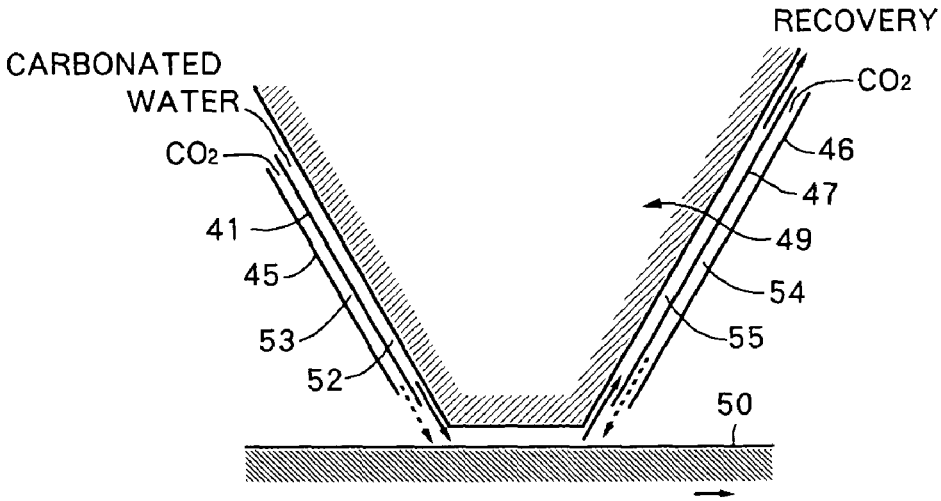
FIG. 8 is an enlarged sectional view showing the jetting head applied to the fourth embodiment, the supply means of the respective fluids arranged at the peripheral area of the head, and the piping state of the recovery tube.

The passages 52 through 55 are, as shown in FIG. 8, open downward, and the acid pickling solution 27 and the carbon dioxide are jetted downward towards the member 50 to be treated from their opening portions. Moreover, the utilized acid pickling solution 27 and carbon dioxide, as well as the cleaned oil and fat portion and oxide film can be intaken upwards through the opening portion of the passage 55, i.e., through the recovery port.

The member 50 to be treated is in the form of a belt-like sheet or cut-metal plate which is movable in a direction as indicated by an arrow through appropriate means. At the time of movement, the member 50 is activated. Strictly to speak, the member 50 is sequentially activated. Generally speaking, the member 50 is almost simultaneously activated.

That is, at the uppermost upstream side position in the moving direction, just under the jetting guide 45, carbon dioxide is sprayed to the member 50 to be treated so as to be degreased and cleaned. Then, at a position just under the jetting guide 41, carbonated water is sprayed to the member 50 so as to be acid pickled. Then, at a position just under the recovery guide 47, the removed oil and fat portion and oxide film, foreign matter such as dust, etc., the utilized carbonated water, carbon dioxide, etc. are pushed or intaken into the member 50 so that the removed oil and fat portion, etc. can be recovered. Moreover, at a position just under the jetting guide 46, the carbon dioxide is sprayed to the member 50 so as to be dried.

The recovery tube 56, which is in communication with the respective passages 55, is connected to an upper end portion of the recovery guide 47. The other end portion of the recovery tube 56 is connected to a separation vessel 57. The separation vessel 57 can received therein the removed oil and fat portion and oxide film, foreign matter such as dust, etc., the utilized carbonated water, carbon dioxide, etc. The contents are reduced in pressure in the separation vessel 57 so that they can b separated into gas-liquid two layers of the acid pickling solution 27 and the carbon dioxide.

In the illustration, reference numeral 59 denotes a filter inserted in the recovery tube 56; 60, a filter disposed at a lower part of the separation vessel 57; and 61, a heater mounted on a peripheral surface of the separation vessel 57, respectively. The heater 61 can heat the separation vessel 57 to about 50 degrees C. so that the carbonated water contained in th recovery solution can be separated into water and carbon dioxide. Reference numeral 62 denotes a discharge tube attached to a bottom portion of the separation vessel 57. A stop valve 63 is inserted in the tube 62.

One ends of return pipes 64, 65 are connected to upper and lower parts of the peripheral surface of the separation vessel 57, and the other ends are connected to the check valve 48 and the liquid storage vessel 38, so that the separated carbon dioxide 58 and carbonated water 27 can be flowed back. In the illustration, reference numeral 66, 67 denote circulation pumps inserted respectively in the return pipes 64, 65, and reference numeral 68, 69 denote dehydrating filters inserted respectively in the return pipes 64, 65.

In this embodiment, the jetting head 49 is installed in place immediately above the member 50 to be treated and the member 50 is moved. It is also accepted that the jetting head 49 is moved and the member 50 is installed in place.

The construction as in the above-mentioned embodiment has such an advantage that the construction is simplified because the mechanism for moving the jetting head 49 and the means for turning the jetting guides 41, 45, 45 and the recovery guide 47 can be eliminated.

An apparatus thus constructed for activating a surface of a base material comprises a liquid storage vessel 38 for generating the acid pickling solution 27 having a predetermined acidity concentration by dissolving a pressurized carbon dioxide in a heated water, an acid pickling solution supply tube 14 for transferring the acid pickling solution 27 generated in the liquid storage vessel 38 to a predetermined position, the degreasing cleaning fluid supply tube 42 for transferring the pressurized carbon dioxide to a predetermined position, the jetting head 49 located at respective end portions of the acid pickling solution supply tube 40, the degreasing cleaning fluid supply tube 42 and the recover tube 56 and disposed immediately above the member 50 to be treated, the separation vessel 57 communicated with the recovery tube 56, and the return pipes 64, 65 one ends of which are connected to the separation vessel 57 and the other ends of which are connected to the liquid storage vessel 38 or degreasing cleaning fluid supply tube 42.

The jetting guides 41, 45, 46 and the recovery guide 42, which are in communication with the acid pickling supply tube 40 and the degreasing cleaning fluid supply tube 42, are arranged on opposite sides of the jetting head 49, in other words, in the back and forth direction in the moving direction of the member 50 to be treated. Among them, the jetting guides 45, 46 are arranged at the outside of the jetting head 49. The jetting ports or recovery port of them are arranged in such a manner as to be directed towards the surface of the member 50 to be treated.

Accordingly, since the exclusive-use degreasing vessel, acid pickling vessel, water cleaning vessels, neutralizing vessel and drying device, which have been conventionally required, are no more required, the equipment can be simplified, the equipment cost can be reduced and the installation space can be made compact. Moreover, since the construction is simple, the apparatus can be made easily and inexpensively.

Moreover, the utilized acid pickling solution 27 and carbon dioxide, as later described, are fed into the separation vessel 57 as one group. After removing the trashes such as oxide film in the vessel 57, they are separated into the carbonated water 27, carbon dioxide 58 and water and then fed into the return pipes 64, 65. Accordingly, the effective utilization can be achieved.

Next, in case the degreasing cleaning treatment, the oxide film removing treatment and the drying treatment are executed with respect to the member 50 to be treated by the above-mentioned activating apparatus, first, the lid 2 is attached to the liquid storage vessel 38 to hermetically close the vessel 38, and then, a predetermined quantity of water is supplied from the water source 7 into the vessel 38.

Thereafter, the gas container 10 is valve-opened to pressurize the carbon dioxide, which is filled in the container 10, by the compression pump 12, and the resultant is supplied into the liquid storage vessel 38. At the same time, the stirring element 4 is actuated to stir the water, and the heater 9 is actuated to heat the water.

By doing so, the carbon dioxide is atomized and moved in the water at a high speed. Also, the atomized carbon dioxide is ascended in its bubbling state and rapidly dissolved in the water. Thus, the dissolving degree of the carbon dioxide is enhanced.

Accordingly, a carbonic acid ($H_2CO_3$) having a sufficient acidity (PH3 through PH4) concentration for acid pickling is rapidly generated. In that case, by adjusting the pressure and temperature depending on the working conditions, an acid pickling solution 27 having an optimal concentration can be generated in accordance with the working conditions.

Instead of the above-mentioned method, if the water is sprayed into the liquid storage vessel 38 in a mist manner and at the same time, if the carbon dioxide is supplied thereto for mixture, the contact surface is more enlarged to enhance the dissolving degree of the carbon dioxide. After the acid pickling solution 27 is generated, the heater 29 and the compression pump 12 are kept actuated to maintain the acidic state.

In this way, after the acid pickling solution 27 is generated, the stop valve 15 is opened to supply the acid pickling solution 27 to the jetting guide 41 through the acid pickling solution supply tube 40. Also, the gas container 10 is valve-opened and the carbon dioxide, which is filled in the container 10, is pressurized by the pressure pump 43 and the pressurized carbon dioxide is then supplied to the jetting guides 45, 46 through the degreasing cleaning fluid supply tube 42.

At that time, the heater 51 of the jetting head 49 is heated so that the jet fluid is prevented from being frozen by its adiabatical expansion. Also, the pressure of the carbon dioxide within the degreasing cleaning fluid supply tube 42 is set higher than the pressure of the acid pickling solution 27 in the acid pickling solution supply tube 40.

By doing so, the acid pickling solution 27 is jetted from each passage 52 of the jetting guide 41, and the carbon dioxide is jetted from each passage 53, 54 of the jetting guides 45, 46. The solution 27 and the carbon dioxide are then vigorously sprayed against the member 50 at a position just under the jetting heat 49.

This state is as shown in FIGS. 7 and 8. The carbon dioxide is jetted from both sides of the jetting head 49 and decomposes and blows off the oil and fat component stuck to the surface of the member 50 to be treated, so that the surface of the member 50 is degreased and cleaned.

At the position which is one side of the jetting head 49 and backward in the moving direction of the member 50, the acid pickling solution 27 is jetted from the inside of the jet stream of the carbon dioxide and decomposes and blows off the oxide film stuck to the surface of the member 50.

At that time, since the carbon dioxide is, as previously mentioned, pressurized to a higher pressure level than the acid pickling solution 27 and located at the jetting portion of the acid pickling solution 27 and at the outside of the recovery passage of the acid pickling solution 27, a sort of air curtain is formed. Thus, at one side of the jetting head 49, the acid pickling solution 27 is prevented from splashing and at the other side of the jetting head 49, the blown off oil and fat component, oxide film, foreign matter, etc. are prevented from scattering.

In that case, although a part of the carbon dioxide can be turned into a dry ice-like state by heat of vaporization at the time of adiabatical expansion, this is possibly prevented by preheating of the heater 1. Even if dry ice should be jetted, the same or similar function and effect as the air curtain could be obtained because its jetting pressure is set higher than the carbonated water 27. Moreover, the fine particles of the dry ice collides with and peels off the oil and fat component of the member 50 to be treated, so that the surface of the member 50 is degreased and cleaned.

The blown off oil and fat portion, oxide film, foreign matter, etc. are once moved to a position just under the jetting head 49 and then pushed into the passage 55 of the recovery guide 47 together with the acid pickling solution 27 and the oxide film which are jetted from one side of the head 49 and moved in a direction as indicated by an arrow of FIG. 8 so as to be introduced into the separation vessel 57 via the recovery tube 56 and the filter 59.

Therefore, the utilized carbon dioxide and acid pickling solution 27 can be recovered with precision, and the oil and fat portion, the oxide film, foreign matter, etc. can be prevented from scattering, thus preventing deterioration of the working environment.

In this way, at the position just under the jetting head 49, the degreasing treatment, the oxide film removing treatment and the drying treatment are executed almost simultaneously. Strictly to speak, their treatment positions are slightly different.

That is, at the uppermost upstream side position, just under the jetting head 49, in the moving direction of the member 50 as shown in FIGS. 7 and 8, the degreasing cleaning treatment is executed by the carbon dioxide, and at the location which is the downstream side position adjacent to the degreasing portion, the oxide film removing treatment is executed by the carbonated water.

At the downstream side position spaced away from the position just under the jetting port portion, the utilized acid pickling solution 27 and the carbon dioxide are recovered, and at the downstream side position adjacent to the recovery portion, the drying treatment is executed by the carbon dioxide.

Accordingly, as the member 50 to be treated is moved in the direction as indicated by the arrow, the above-mentioned treatments are sequentially executed. That is, the member 50 is subjected to the degreasing cleaning treatment at a position just under the jetting port of the passage 53, and at the position just under the recovery port of the passage 55, the jetted acid pickling solution 27, carbon dioxide, foreign matter, etc. are recovered and dried. By this, a series of treatments are finished.

In this way, the acid pickling solution and carbon dioxide received in the separation vessel 57 and the oil and fat component, oxide film, etc. are separately roughly into gas-liquid two layers of the acid pickling solution 27 and the carbon dioxide 58. That is, the carbon dioxide is located at a higher position and the acid pickling solution 27 is location at a lower position.

In that case, since the acid pickling solution 27 is jetted into the atmosphere and already reduced in pressure, the dissolving degree of the carbon dioxide is lowered and its acidity concentration is lowered. The carbon dioxide 58 is also jetted into the atmosphere and reduced in pressure. Since air is mixed in the carbon dioxide 58, purity of the carbon dioxide 58 is lowered.

Under the above-mentioned status, the circulation pumps 66, 67 are actuated to intake the carbon dioxide 58 and the acid pickling solution 27 into the return pipes 64, 65, and the moisture and trashes are removed by the filters 68, 69. Thereafter, the resultant is pressurized by the pumps 66, 67.

Among them, the carbon dioxide 58 is pressurized by the circulation pump 66 and cooled and turned into a liquid state. The carbon dioxide 58 in a liquid state is converged with a high pressure fresh carbon dioxide, moved into the jetting guides 45, 46 guided by the supply tube 42 and then jetted from the passages 53, 54.

In this way, by pressurizing the reutilizing carbon dioxide 58, the dissolving degree of moisture is lowered. In other words, by removing moisture, a dried carbon dioxide 58 is generated. Thus, the above-mentioned drying effect is enhanced.

On the other hand, the acid pickling solution 27 is pressurized by the circulation pump 67 and fed into the liquid storage vessel 38. Then, the high pressure acid pickling solution 27 having a predetermined concentration is fed into the supply tube 40 from the vessel 38, moved to the jetting guide 41 and then jetted from the passage 52.

In that case, the above-mentioned utilized acid pickling solution 27 is flowed back into the liquid storage vessel 38 from the return pipe 65. When the acidity concentration is lowered in the vessel 38, this status is detected by the PH sensor 39 and the detection signal is inputted to the compression pump 12.

Thus, the compression pump 12 is actuated to feed a predetermined quantity of carbon dioxide into the liquid storage vessel 38 where the carbon dioxide is dissolved in water, so that the acidity concentration of the acid pickling solution 27 in the liquid storage vessel 38 is adjusted.

In this way, according to the present invention, the degreasing cleaning treatment, the oxide film removing treatment and the drying treatment are simultaneously executed with respect to the member 50 to be treated and the water cleaning treatment, which is troublesome, is no more required. Accordingly, this kind of treating work can be made easily and rapidly. Thus, the productivity is enhanced.

Moreover, since the harmful alkali or acidic chemicals, which have been conventionally required, are no more required as a medium for the degreasing treatment and the oxide film removing treatment, the inferior working conditions as under harmful gas generation can be improved and the treatments can be executed safely, rapidly and easily.

Moreover, the carbon dioxide and the acid pickling solution 27, which were once utilized, are rapidly recovered to remove their contamination. At the same time, lowering of their function is corrected to recover the intended function. Thus, an equipment can be provided in a reasonable and inexpensive manner.

Since the separation vessel 57 is reduced in pressure and the dissolving degree of the carbon dioxide is lowered at the time for recovering the acid pickling solution 27 and the carbon dioxide, the acidity concentration is lowered to eliminate the fear of actual damage. Thus, it becomes possible to open the stop valve 63 so that the acid pickling solution 27 is discharged directly to the drainage from the discharge tube 62.

If it is arranged such that the jetting time and pressure of the jetting fluid which is to be jetted from the passages 52 through 54, the moving speed of the member 50 to be treated, etc. can be adjusted and the gap between the jetting head 49 and the member 50 can be adjusted, a very delicate activating treatment can be executed depending on the conditions of the surface of the member 50.

Figure 10:
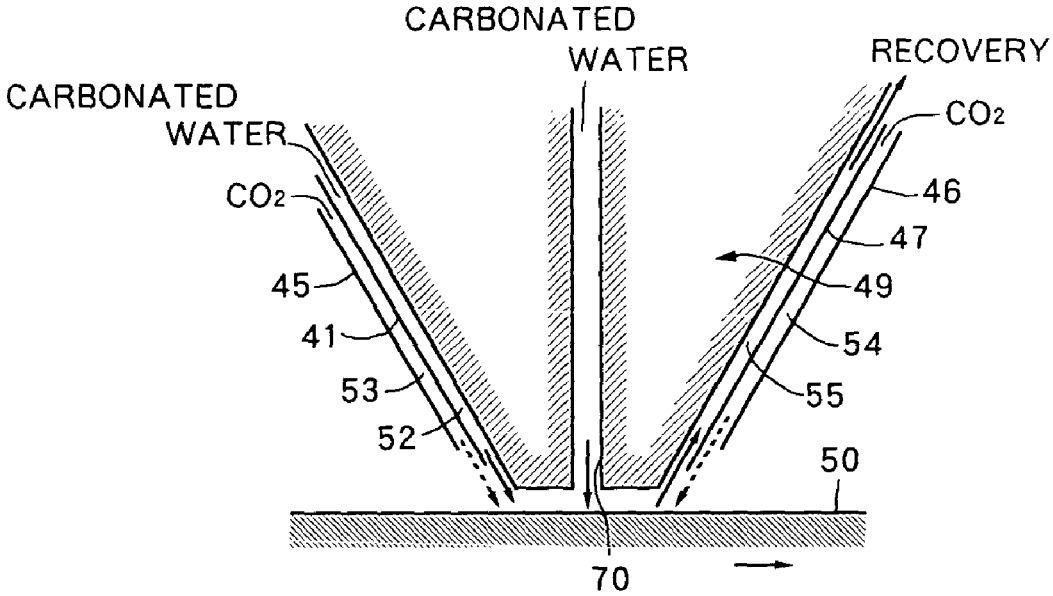
FIG. 10 shows a fifth embodiment of the present invention and is an enlarged sectional view showing a jetting head, jetting guides of respective fluids disposed at the peripheral area of the head and the arrangement of a recovery guide, in which a supply passage of an oxide film removing fluid (carbonated water) is disposed at the center of the jetting head.

FIGS. 10 through 13 show other embodiments of the above-mentioned fourth embodiment. Of those FIGURES, FIG. 10 shows a fifth embodiment of the present invention.

In this embodiment, a plurality jet holes 70 are formed in the lower surface of the jetting head 49 along the long direction thereof. Those jet holes 70 are communicated with the oxide film removing fluid supply tube 40 so that the acid pickling solution 27 is jetted directly from the jet holes 70.

By additionally providing the jetting portions of the acid pickling solution 27 to the jetting head 49 in the manner as mentioned above, the removing treatment of the oxide film can be executed with precision and efficiently. Moreover, by providing the jetting portion at the inside of the jetting head 49, the construction is simplified without a need of the jetting guide 41.

Figure 11:
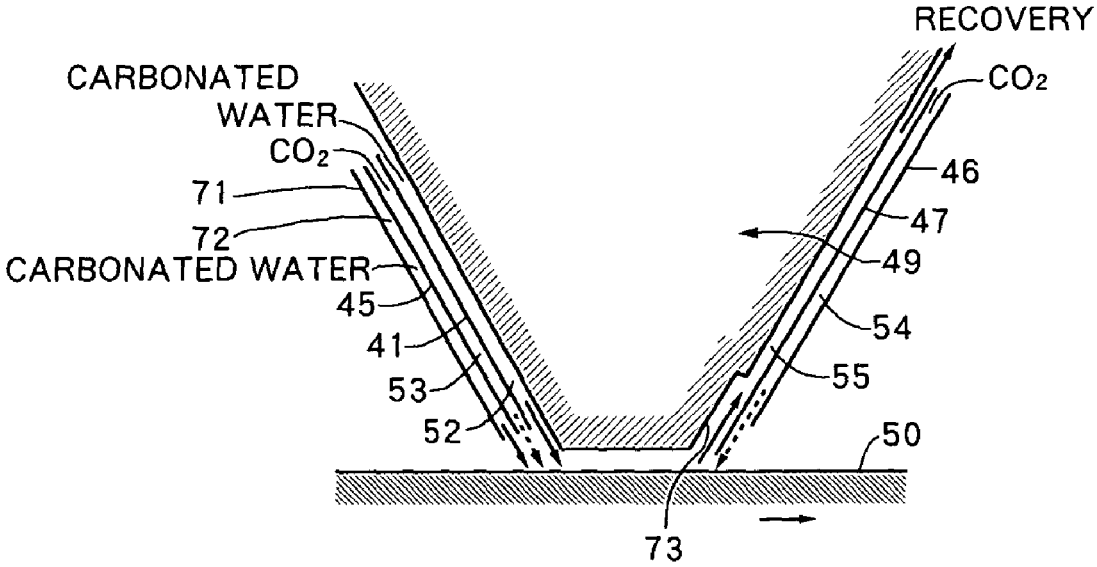
FIG. 11 shows a sixth embodiment of the present invention and is an enlarged sectional view showing a jetting head, jetting guides of respective fluids disposed at the peripheral area of the head and the arrangement of a recovery guide, in which supply passages of an oxide film removing fluid (carbonated water) are arranged one at an inner side and the other at an outer side of one side of the jetting head, and a supply passage of a degreasing cleaning fluid (carbon dioxide) is disposed between those supply passages.

FIG. 11 shows a sixth embodiment of the present invention. In this embodiment, a jetting guide 71, which is in communication with the oxide film fluid supply tube 40, is additionally provided to one side of the jetting head 49 and a plurality of passages 72 are formed in the guide 71.

In this embodiment, a jetting portion of the carbonated water is additionally provided to one side of the jetting head 49 so that the removal of the oxide film can be executed with precision and efficiently. Moreover, a notch portion 73 is provided in such a manner as to face with the recovery port of the recovery guide 47 so that the increased acid pickling solution 27 can be recovered efficiently.

Figure 12:
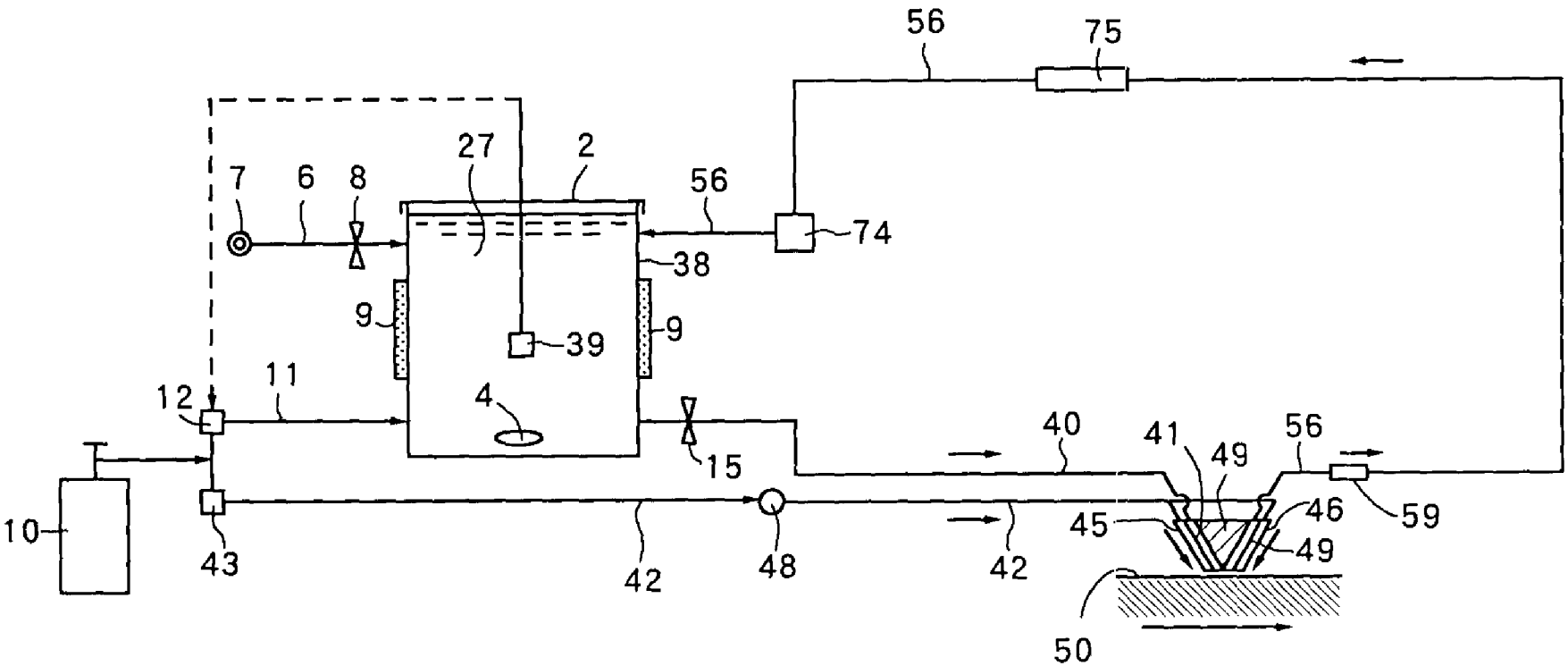
FIG. 12 shows a seventh embodiment of the present invention, in which the above-mentioned separation vessel is omitted and the utilized fluids are flowed back directly to the oxide film removing fluid supply sources.

FIG. 12 shows a seventh embodiment of the present invention. In this embodiment, the above-mentioned separation vessel 57 and the return pipes 64, 65 are omitted. Instead, a recovery tube 56 is employed which is connected to the liquid storage vessels 38, and a vacuum pump 74 and a filter 75 are inserted in the tube 56.

The acid pickling solution 27 and the carbon dioxide, which were sprayed to the member 50 to be treated, and the removed degreasing component and oxide film, etc. are sucked altogether by the vacuum pump 74 so as to be fed into the recovery tube 56. Of all, the degreasing component, the oxide film, etc. are removed through the filters 59, 75, and the remaining acid pickling solution 27 and the carbon oxide are fed into the liquid storage vessel 38.

The acid pickling solution 27 fed into the liquid storage vessel 38 is mixed with the acid pickling solution 27 in the vessel 38 so that a predetermined acidity concentration is recovered and then moved into the oxide film removing fluid supply tube 40.

On the other hand, the carbon dioxide fed into the liquid storage vessel 38 is heated, pressurized and then dissolved in the water in the vessel 38, thereby enhancing the acidity concentration. Accordingly, it becomes possible to obviate such inconveniences that the utilized acid pickling solution 27 and carbon dioxide are decomposed and only thereafter they are reutilized. In this embodiment, the utilized acid pickling solution 27 and carbon dioxide can be reutilized in a reasonable form.

In this way, in the seventh embodiment, the construction is simplified by eliminating the separation vessel 57. Thus, this kind of apparatus can be made easily and inexpensively. Moreover, the utilized acid pickling solution 27 and carbon dioxide can be fed directly into the liquid storage vessel 38 without sorting. In the liquid storage vessel 38, the acid pickling solution 27 is regenerated and the carbon dioxide is utilized for generating the acid pickling solution 27.

Then, by utilizing the regenerated acid pickling solution 27 and carbon dioxide, the activating treatment is executed with respect to the member 50 to be treated.

Figure 13:
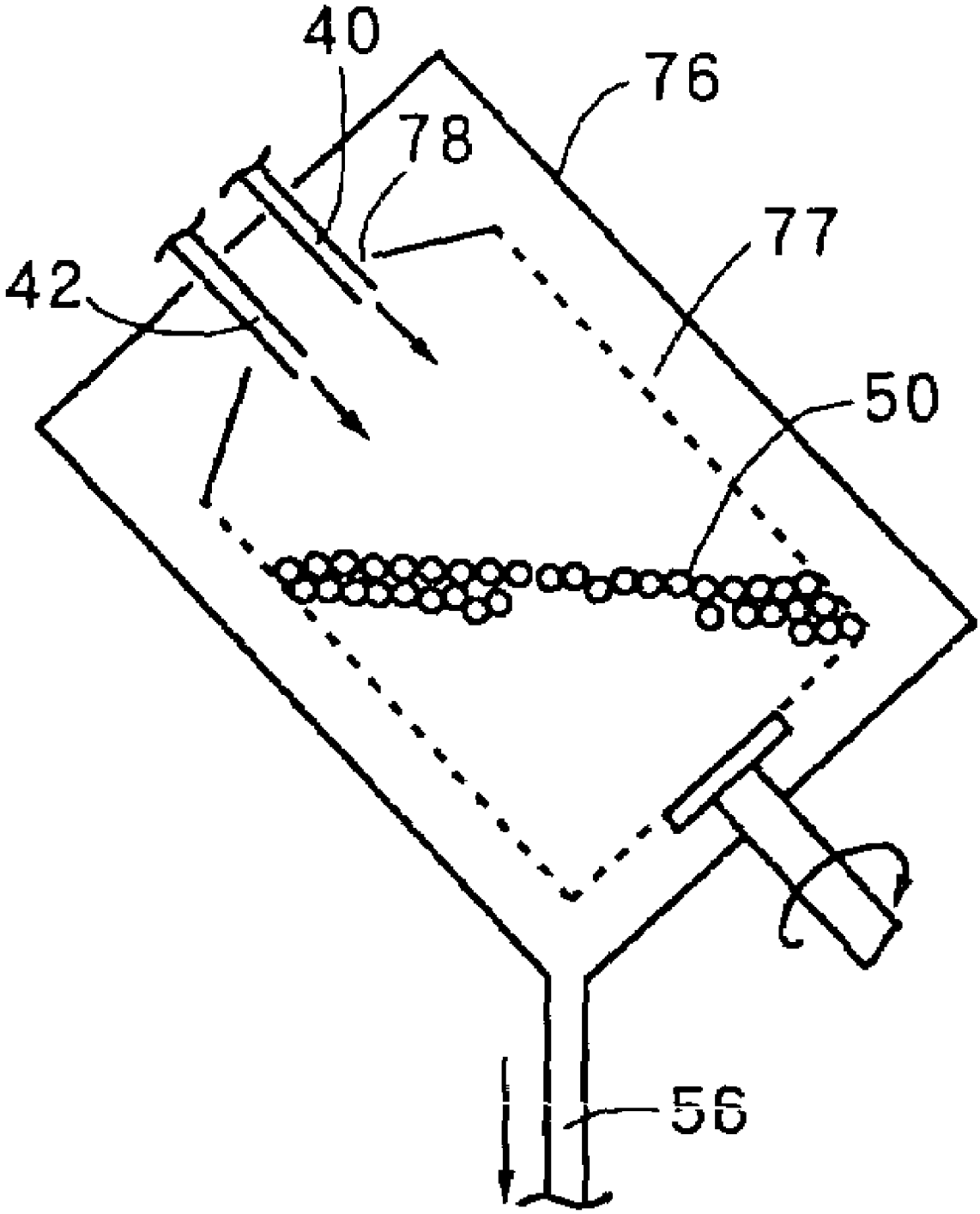
FIG. 13 shows an eighth embodiment of the present invention showing a state in which a granular member to be treated is received in an inner sleeve and the inner sleeve is rotated, and then an oxide film removing fluid (carbonated water) and a degreasing cleaning fluid (carbon dioxide) are supplied to the rotating inner sleeve and subjected to activation treatment within the rotating inner sleeve.

FIG. 13 shows an eighth embodiment of the present invention. In this embodiment, an outer sleeve 76 is disposed in such a manner as to direct slantwise upwards and an inner sleeve 77 is rotatably disposed at the inside of the outer sleeve 76. A plurality of granular or lump members 50 to be treated are received in the inner sleeve 77.

A mesh or a plurality of small holes are formed in the periphery of the inner sleeve 77, an opening portion 78 is provided to an upper part thereof, the oxide film removing fluid supply tube 40 and the degreasing cleaning fluid supply tube 42 are arranged at the opening portion 78 so that the acid pickling solution and the carbon dioxide are jetted towards the member 50 therethrough, and the utilized fluid is flowed back into the separation vessel 57 or liquid storage vessel 38 through the recovery tube 56.

That is, in this embodiment, while rotating the granular or lump members 50, the acid pickling solution and carbon oxide are sprayed thereto so that the degreasing cleaning treatment and the oxide film removing treatment are simultaneously executed with respect to the members 50.

In the above-mentioned embodiment, if it is arranged such that the carbon dioxide jetted from the jetting guides 45, 46 is set to a high pressure high temperature level, the carbon dioxide is adiabatically expanded at the time of jetting so that dry ice is generated by the heat of vaporization thereof, this dry ice is vigorously jetted so as to be finely particulated, and then the finely particulated dry ice is collided against the members 50, the oil and fat portion stuck to the surfaces of the members 50 can surely be peeled off.

Moreover, as another means, if the carbon dioxide is brought into a supercritical state and then sprayed to the members 50, the degreasing component stuck to the members 50 can be decomposed and removed with precision.

INDUSTRIAL APPLICABILITY

As described hereinbefore, a method for activating the surface of a base material and an apparatus thereof according to the present invention is suited to be utilized for pretreatment in electrochemical treatment such as, for example, electroplating or the like, the surface of a base material such as metal being able to be subjected to degreasing treatment and oxide film removing treatment simultaneously, efficiently and rationally, productivity being enhanced and the equipment cost being reduced, and a waste solution being rationalized so that the solution can be reutilized and the environmental pollution can be prevented.

The invention claimed is:

1. A method for treating a substrate comprising:

providing a substrate comprising grease on a surface thereof;

contacting the substrate with supercritical carbon dioxide produced from pressurized carbon dioxide from a pressurized carbon dioxide source so that the grease on the surface of the substrate is separated or peeled off to perform degreasing cleaning;

dissolving pressurized carbon dioxide from said pressurized carbon dioxide source in water to generate an oxide film removing solution comprising carbonated water; and contacting the substrate with the oxide film removing solution so as to remove oxide film on the surface of the substrate, the degreasing cleaning and oxide film removal being simultaneously performed and the degreasing cleaning and oxide film removal treatment being performed in a space that is not hermetically sealed; and providing a spray gun connected separately to the oxide film removing solution and to the supercritical carbon dioxide, wherein said contacting of the substrate with the supercritical carbon dioxide and said contacting of the substrate with the oxide film removing solution comprises simultaneously jetting the oxide film removing solution from a first jetting port and the supercritical carbon dioxide from a second jetting port formed in the spray gun.

2. A method for treating a substrate according to claim 1, further comprising:

providing a compression air source in communication with an annular aperture in the spray gun, the annular aperture being formed around said second jetting port.

3. A method for treating a substrate according to claim 1, wherein the jetting ports are provided spaced from one another, said jetting ports defining a direction from said first jetting port to said second jetting port; and the spray gun is moved in said direction from said first jetting port towards said second jetting port so that supercritical carbon dioxide is jetted to a portion of said substrate and degreasing cleaning is performed on said portion of said substrate, and then the oxide film removing solution is jetted on said portion of said substrate, and an oxide film is removed from said portion of said substrate.

* * * * *